US011373467B2

(12) United States Patent
Jonsson

(10) Patent No.: US 11,373,467 B2
(45) Date of Patent: Jun. 28, 2022

(54) CONTROLLING A LOCK BASED ON AN ACTIVATION SIGNAL AND POSITION OF PORTABLE KEY DEVICE

(71) Applicant: ASSA ABLOY AB, Stockholm (SE)

(72) Inventor: Tomas Jonsson, Rönninge (SE)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 16/347,905

(22) PCT Filed: Nov. 17, 2017

(86) PCT No.: PCT/EP2017/079614
§ 371 (c)(1),
(2) Date: May 7, 2019

(87) PCT Pub. No.: WO2018/091660
PCT Pub. Date: May 24, 2018

(65) Prior Publication Data

US 2019/0287329 A1 Sep. 19, 2019

(30) Foreign Application Priority Data

Nov. 17, 2016 (EP) ..... 16199308

(51) Int. Cl.
*G07C 9/00* (2020.01)
*G07C 9/28* (2020.01)

(52) U.S. Cl.
CPC ..... *G07C 9/00309* (2013.01); *G07C 9/00174* (2013.01); *G07C 9/28* (2020.01);
(Continued)

(58) Field of Classification Search
CPC ... G07C 9/00309; G07C 9/28; G07C 9/00174
See application file for complete search history.

(56) References Cited

U.S. PATENT DOCUMENTS

2006/0283216 A1* 12/2006 Marcelle ..... G07C 9/00182 70/38 A
2010/0277276 A1* 11/2010 Bayne ..... G07C 9/10 340/5.21

(Continued)

FOREIGN PATENT DOCUMENTS

CN 104464040 3/2015
CN 205063572 3/2016

(Continued)

OTHER PUBLICATIONS

International Search Report and Written Opinion for International (PCT) Patent Application No. PCT/EP2017/079614, dated Jan. 17, 2018, 13 pages.

(Continued)

*Primary Examiner* — Nabil H Syed
(74) *Attorney, Agent, or Firm* — Sheridan Ross P.C.

(57) ABSTRACT

It is presented a method for controlling a lock configured to control access to a restricted physical space, the method being performed in a lock controller. There is a respective active space associated with each lock. The method comprises the steps of: receiving an activation signal from an activation device, the activation signal being based on the portable key device being located within the active space associated with the lock; obtaining an indication that the portable key device is granted access to the lock; determining a second indication of position of the portable key device using a second positioning procedure, wherein the second positioning procedure is more accurate than the first positioning procedure; determining intent to open based on the second indication of position; and transmitting an unlock signal to the lock associated with the lock controller.

15 Claims, 3 Drawing Sheets

(52) U.S. Cl.
CPC ..... *G07C 2009/00333* (2013.01); *G07C 2009/00404* (2013.01); *G07C 2009/00769* (2013.01); *G07C 2209/63* (2013.01)

(56) References Cited

U.S. PATENT DOCUMENTS

| | | | | |
|---|---|---|---|---|
| 2013/0015947 | A1 | 1/2013 | Best | |
| 2013/0127591 | A1 | 5/2013 | Shay et al. | |
| 2013/0176107 | A1 | 7/2013 | Dumas et al. | |
| 2015/0228134 | A1 | 8/2015 | Tehranchi et al. | |
| 2016/0104334 | A1* | 4/2016 | Handville ..... | G07C 9/00309 340/5.61 |
| 2017/0074000 | A1* | 3/2017 | Banvait ..... | B60R 25/01 |
| 2017/0301166 | A1* | 10/2017 | Earles ..... | G06F 21/35 |

FOREIGN PATENT DOCUMENTS

| | | |
|---|---|---|
| CN | 105612464 | 5/2016 |
| CN | 105723043 | 6/2016 |
| CN | 107004317 | 8/2017 |
| FR | 2949268 | 2/2011 |

OTHER PUBLICATIONS

English Translation of Official Action for China Patent Application No. 201780070686.3, dated Feb. 2, 2021, 11 pages.
Official Action for European Patent Application No. 17797668.5, dated Dec. 15, 2021, 10 pages.
English Translation of Official Action for China Patent Application No. 201780070686.3, dated Mar. 7, 2022, 7 pages.

* cited by examiner

CONTROLLING A LOCK BASED ON AN ACTIVATION SIGNAL AND POSITION OF PORTABLE KEY DEVICE

CROSS REFERENCE TO RELATED APPLICATIONS

This application is a national stage application under 35 U.S.C. 371 and claims the benefit of PCT Application No. PCT/EP2017/079614 having an international filing date of 17 Nov. 2017, which designated the United States, which PCT application claimed the benefit of European Patent Application No. 16199308.4 filed 17 Nov. 2016, the disclosure of each of which are incorporated herein by reference.

TECHNICAL FIELD

The invention relates to a method, a lock controller, computer program and computer program product for controlling a lock based on an activation signal and position of portable key device.

BACKGROUND

Locks and keys are evolving from the traditional pure mechanical locks. These days, there are wireless interfaces for electronic locks, e.g. by interacting with a portable key device. For instance, Radio Frequency Identification (RFID) has been used as the wireless interface.

When RFID is used, the user needs to present the portable key device in close proximity to a reader connected to the lock. Moreover, RFID requires a relatively large antenna in the reader by the lock and uses a large amount of energy.

Another solution is to use Ultra High Frequency (UHF). However, with UHF, the range is longer and it is difficult to determine intent. Moreover, if there are several locks in a small area, a single present authorised portable key device risks unlocking more than the lock which the user intends to unlock.

SUMMARY

It is an object to more efficiently determine when there is intent of a user to open a lock.

According to a first aspect, it is presented a method for controlling a lock configured to control access to a restricted physical space, the method being performed in a lock controller connected to the lock, the lock being one of a plurality of locks, wherein there is a respective active space associated with each one of the plurality of locks. The method is performed by the lock controller and comprises the steps of: entering a sleep state, in which the lock controller is unable to receive an activation signal; entering a communication state, in which the lock controller is able to receive an activation signal; receiving, while in the communication state, an activation signal from an activation device, the activation signal being based on a portable key device being located within the active space associated with the lock, based on a first indication of position of the portable key device obtained from a first positioning procedure; obtaining an indication that the portable key device is granted access to the lock; determining a second indication of position of the portable key device using a second positioning procedure, wherein the second positioning procedure is more accurate than the first positioning procedure; determining intent to open based on the second indication of position; and transmitting an unlock signal to the lock associated with the lock controller.

The indication that the portable key device is granted access may form part of the activation signal.

The step of obtaining the indication that the portable key device is granted access to the lock comprises determining access based on communication between the lock controller and the portable key device to authenticate the portable key device.

In the step of determining intent to open, a threshold of determining intent may be based on the identity of the portable key devices.

In the step of determining intent to open, a threshold of determining intent may be based on historic data associated with the portable key devices.

In the step of determining intent to open, a threshold of determining intent of may be based on time.

In the step of determining intent to open, a threshold of determining intent may be based on statistics of previously determined intent and corresponding opening of a barrier associated with the lock.

The method may further comprise the step of: detecting, using the second positioning procedure, how many portable key devices pass through a physical barrier associated with the lock.

The method may further comprise the step of: determining whether there is strong intent to open, in which case the step of transmitting an unlock signal is performed when there is strong intent.

According to a second aspect, it is presented a lock controller for controlling a lock configured to control access to a restricted physical space, the lock being one of a plurality of locks, wherein there is a respective active space associated with each one of the plurality of locks. The lock controller comprises: a processor; and a memory storing instructions that, when executed by the processor, cause the lock controller to: enter a sleep state, in which the lock controller is unable to receive an activation signal; enter a communication state, in which the lock controller is able to receive an activation signal; receive, while in the communication state, an activation signal from an activation device, the activation signal being based on the portable key device being located within the active space associated with the lock, based on a first indication of position of the portable key device obtained from a first positioning procedure; obtain an indication that the portable key device is granted access to the lock; determine a second indication of position of the portable key device using a second positioning procedure, wherein the second positioning procedure is more accurate than the first positioning procedure; determine intent to open based on the second indication of position; and transmit an unlock signal to the lock associated with the lock controller.

The instructions to determine intent to open may comprise instructions that, when executed by the processor, cause the lock controller to use a threshold of determining intent based on the identity of the portable key devices.

The instructions to determine intent to open may comprise instructions that, when executed by the processor, cause the lock controller to use a threshold of determining intent based on historic data associated with the portable key devices.

According to third first aspect, it is presented a computer program for controlling a lock configured to control access to a restricted physical space, the method being performed in a lock controller connected to the lock, the lock being one of a plurality of locks, wherein there is a respective active space associated with each one of the plurality of locks. The computer program comprises computer program code which, when run on a lock controller, causes the lock controller to: receive an activation signal from an activation device, the activation signal being based on the portable key device being located within the active space associated with the lock, based on a first indication of position of the portable key device obtained from a first positioning procedure; obtain an indication that the portable key device is granted access to the lock; determine a second indication of position of the portable key device using a second positioning procedure, wherein the second positioning procedure is more accurate than the first positioning procedure; determine intent to open based on the second indication of position; and transmit an unlock signal to the lock associated with the lock controller.

According to a fourth aspect, it is presented a computer program product comprising a computer program according to the third aspect and a computer readable means on which the computer program is stored.

According to a fifth aspect, it is presented an access control system for controlling a lock configured to control access to a restricted physical space, the lock being one of a plurality of locks, wherein there is a respective active space associated with each one of the plurality of locks, the access control system comprising an activation device comprising: a processor; and a memory storing instructions that, when executed by the processor, cause the activation device to: determine a first indication of position of the portable key device using a first positioning procedure; determine when the portable key device is located within the active space associated with the lock, based on the first indication of position; transmit an activation signal to the lock controller associated with the lock of the active space, when the portable key device is located within the active space associated with the lock; wherein the access control system further comprising a plurality of lock controllers (18*a-d*), each one of which comprises: a processor; and a memory storing instructions that, when executed by the processor, cause the lock controller to: enter a sleep state, in which the lock controller is unable to receive an activation signal; enter a communication state, in which the lock controller is able to receive an activation signal; receive, while in the communication state, an activation signal from the activation device; obtain an indication that the portable key device is granted access to the lock; determine a second indication of position of the portable key device using a second positioning procedure, wherein the second positioning procedure is more accurate than the first positioning procedure; determine intent to open based on the second indication of position; and transmit an unlock signal to the lock associated with the lock controller.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
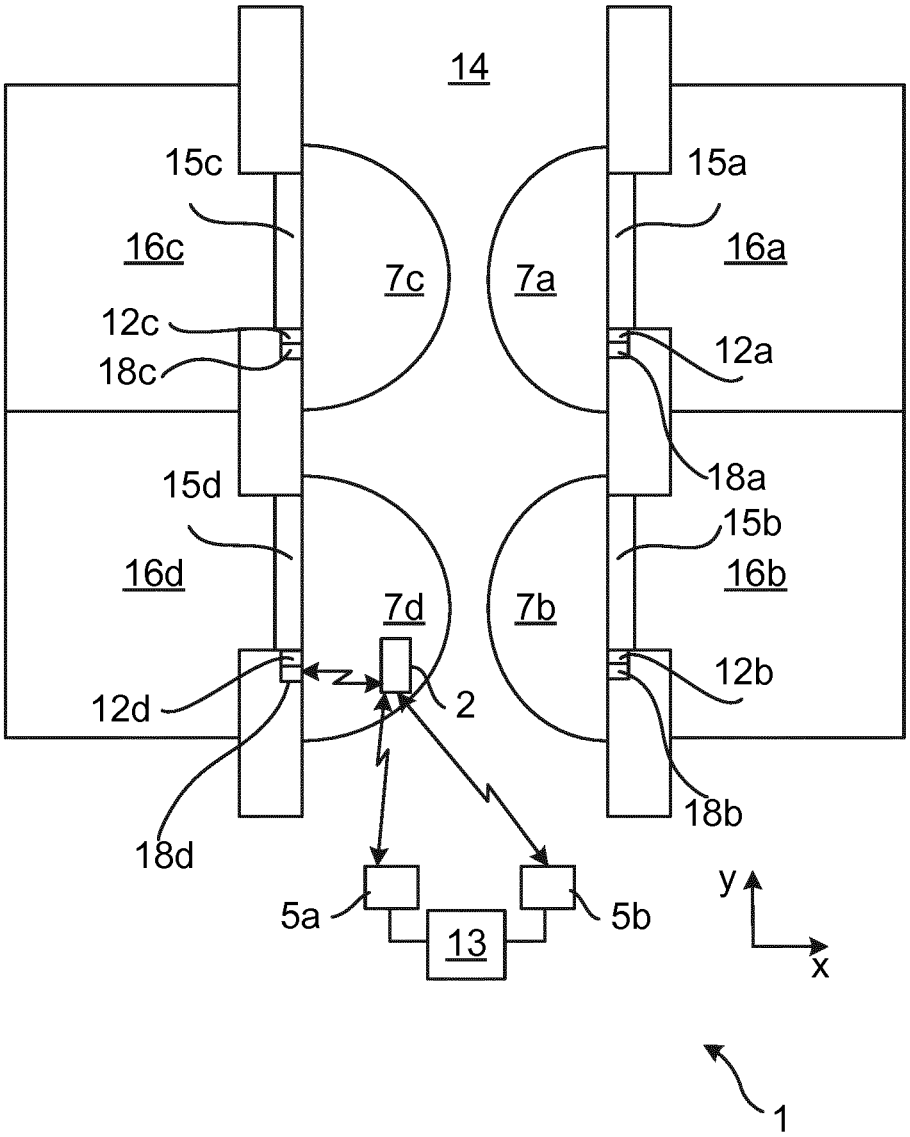
FIG. 1 is a schematic top view diagram showing an environment in which embodiments presented herein can be applied in two dimensions.

FIG. 1 is a schematic diagram showing an environment in which embodiments presented herein can be applied. Access to a plurality of restricted physical spaces 16*a-d* is restricted by respective physical barriers 15*a-d* which are selectively unlockable as controlled by a respective lock 12*a-d*. Each lock 12*a-d* is controlled by a respective lock controller 18*a-d*. The restricted physical spaces can e.g. be flats, offices, hotel rooms, etc.

The physical barriers 15*a-d* stand between the respective restricted physical spaces 16*a-d* and an accessible physical space 14. It is to be noted that the accessible physical space 14 can be a restricted physical space in itself, but in relation to these physical barriers 15*a-d*, the accessible physical space 14 is accessible. The barriers 15*a-d* can be doors, gates, hatches, cabinet doors, drawers, windows, etc. In order to unlock any one of the barriers 15*a-d*, the activation device 13 is provided.

A user of the access control system carries a portable key device 2 to thereby unlock one of the locks 12*a-d*. The portable key device 2 can be carried or worn by the user and may be implemented as a mobile phone, a smartphone, a key fob, wearable device, smart phone case, access card, etc.

The lock controllers 18*a-d* are connected to respective physical locks 12*a-d*, which are controllable by the lock controller 18*a-d* to be set in an unlocked state or locked state.

In one embodiment, the lock controllers 18*a-d* communicate with a portable key device 2 using a credential interface over a wireless interface for authentication of the portable key device 2. The portable key device 2 is any suitable device portable by a user and which can be used for authentication over the wireless interface.

In one embodiment, the activation device 13 communicates with the portable key device 2 for authentication of the portable key device. In FIG. 1, two antennas 5*a-b* can be seen for this communication. However, there may be fewer or more antennas provided in connection with the activation device 13. The antennas 5*a-b* can optionally also be used for communicating with the lock controllers 18*a-d*, e.g. for sending an activation signal to a lock controller.

Using wireless communication (from any of the lock controllers 18*a-d* or the activation device 13), the authenticity of the portable key device can be checked in an access control procedure, e.g. using a challenge and response scheme, after which the activation device 13, or the lock controller 18*a-d* in question, grants or denies access. The antennas 5*a-b* may also be used in determining a position of the portable key as an example of a first positioning procedure device 2, e.g. using angle of arrival.

Each combination of barrier 15*a-d*, lock 12*a-d* and lock controller 18*a-d* has a respectively associated active space 7*a-d*. Each active space 7*a-d* is defined such that when a user (or more accurately the portable key device 2 of a user) is located in an active space, e.g. using the first positioning procedure, this is used by the activation device 13 as a trigger to activate the lock controller for a more accurate second positioning procedure. In this way, the activation device 13 can be used to keep track of any portable key devices in the area, without the activation device 13 going to sleep. Only when a portable key device 2 enters an active space, is the activation signal sent to the associated lock controller, which can thus be in a power save mode and be awakened by the activation signal.

Using the second positioning procedure, the lock controller then determines a intent to open the lock associated with the lock controller. Intent in this context is here sufficient to proceed. However, if there is no intent, there is optionally a determination of whether there is strong intent. If there is strong intent (as detailed below), even in the absence of the general intent described above, the unlocking procedure continues. In this way, the strong intent operates as a fallback procedure if the intent described above is not sufficient to determine intent.

When positioning of devices is performed, it can be determined that the device is in a certain position with a certain accuracy. With many positioning procedures today, this accuracy is around 2-3 metres, but can be as low as 1 meter. Accuracy is improved using several samples and fillers, e.g. Kalman filters. Optionally, accuracy can also be improved using characterisation, i.e. when the way that the user carries the portable key device (e.g. in a necklace band around the neck, left pocket, right pocket, etc.) is identified and compensated for. Also, accuracy can be improved by combining several positioning procedures, such as fingerprinting (of radio environment, e.g. Wi-Fi access points), RSSI (Received Signal Strength Indicator), AoA (Angle of Arrival), ToA (Time of Arrival), etc.

Hence, the position of the portable key device 2 is detected using two separate positioning procedures and used by the activation device 13 with reference to the active spaces 7*a-d* to know which lock controller to activate for the second stage.

The second positioning procedure, by the lock controller, is such that it is difficult to be used for continuous monitoring of portable key devices of users that may or may not have intent of unlocking using the lock controller. Moreover, there may be a large number of portable key devices passing by (e.g. in a hotel, hospital, office corridor or similar), which may result in many queries leading to energy usage and battery drain when batteries are used for the energy source. By using the first positioning procedure as a intent determination and only then activating the lock controller and the second positioning procedure, the lock controller can be in sleep mode until activated, saving great amounts of energy.

When the access control procedure results in granted access, the lock controller 18*a-d* in question transmits an unlock signal to the associated lock 12*a-d*, whereby that lock 12*a-d* is set in an unlocked state. The unlock signal from the lock controller 18*a-d* in question to the lock 12*a-d* can be communicated using wireless communication over any suitable wireless interface, e.g. using Bluetooth, Bluetooth Low Energy (BLE), any of the IEEE 802.15 standards, Radio Frequency Identification (RFID), any of the IEEE 802. 11 standards, wireless USB (Universal Serial Bus), etc. Alternatively or additionally, the communication can occur using wire based communication, e.g. using USB, Ethernet, serial connection (e.g. RS-485), etc. When a lock 12*a-d* is in an unlocked state, its respective barrier 15*a-d* can be opened and when the lock 12*a-d* is in a locked state, its respective barrier 15*a-d* is prevented from being opened. In this way, access to restricted spaces 16*a-d* is controlled by the activation device 13 and the lock controller 18*a-d* in question.

In the example shown in FIG. 1, the activation device 13 determines that the portable key device 2 is within the fourth active space 7*d*, associated with the fourth lock controller 18*d* and the fourth lock 12*d*. Hence, the activation device 13 transmits an activation signal to the fourth lock controller 18*d* which performs a positioning using the second positioning procedure.

An access control system 1 can be considered to comprise the activation device 13, the lock controllers 18*a-d*, and optionally also the locks 12*a-d*.

While the access control system is here shown with four locks, the access control system can be provided with any suitable number of locks. The access control system in FIG. 1 is used for determination of position and active spaces in two dimensions, x-y.

In one embodiment, the portable key device 2 implements the function of the activation device 13, e.g. if the portable key device 2 is a smartphone and can obtain the first indication of position using GPS or other positioning procedure available for the portable key device. In such an embodiment, each portable key device 2 is also an activation device.

Figure 2:
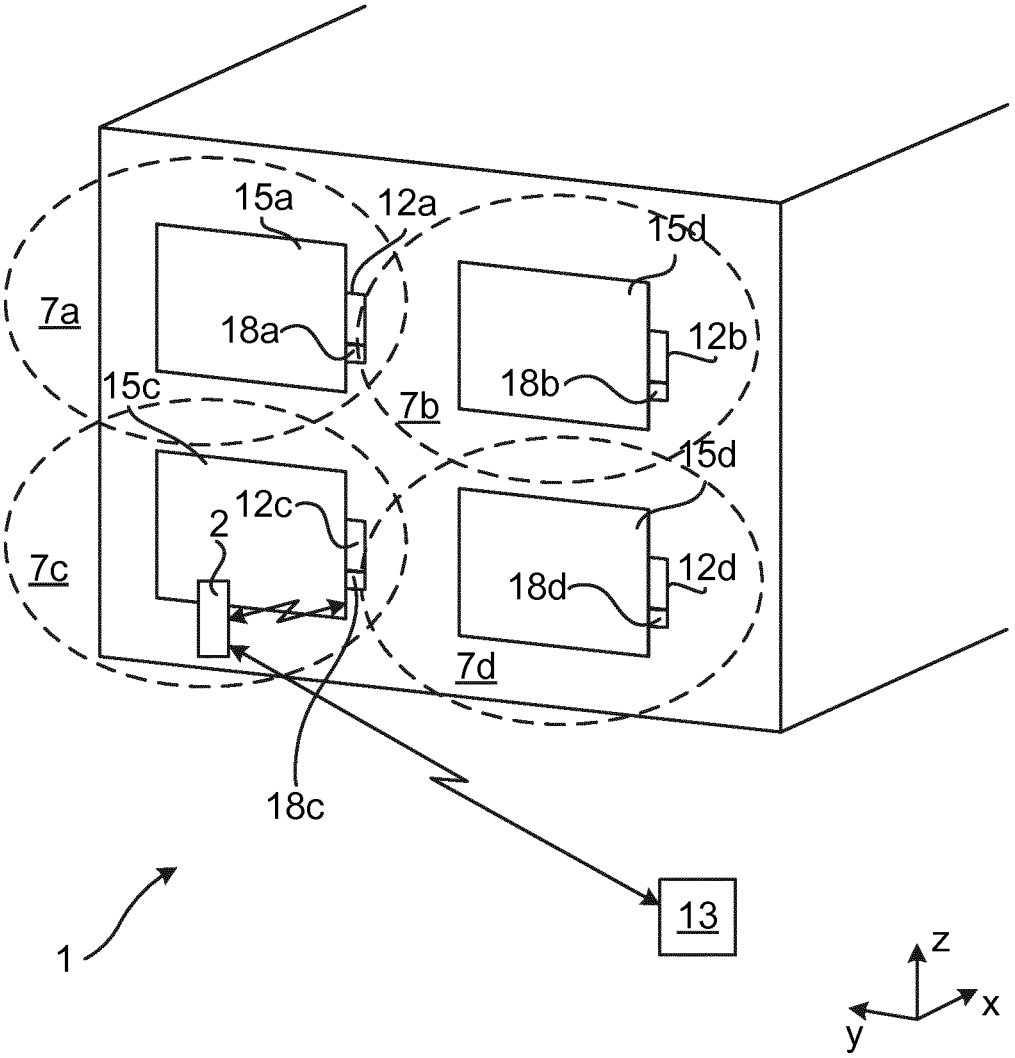
FIG. 2 is a schematic perspective view diagram showing an environment in which embodiments presented herein can be applied in three dimensions.

FIG. 2 is a schematic perspective view diagram showing an environment in which embodiments presented herein can be applied in three dimensions. The access control system 1 works in the same way as illustrated in FIG. 1. Here however, the position of the portable key device 2 is determined in three dimensions x-y-z and each one of the active spaces 7*a-d* is defined in three dimensions x-y-z. Using three dimensions, this access control system 1 can e.g. be used for controlling access to cabinet doors, drawers, etc. Again, the system can be provided with any suitable number of locks and respective barriers, for which access is controlled using the activation device 13 and the lock controllers 18*a-d*.

Figure 3:
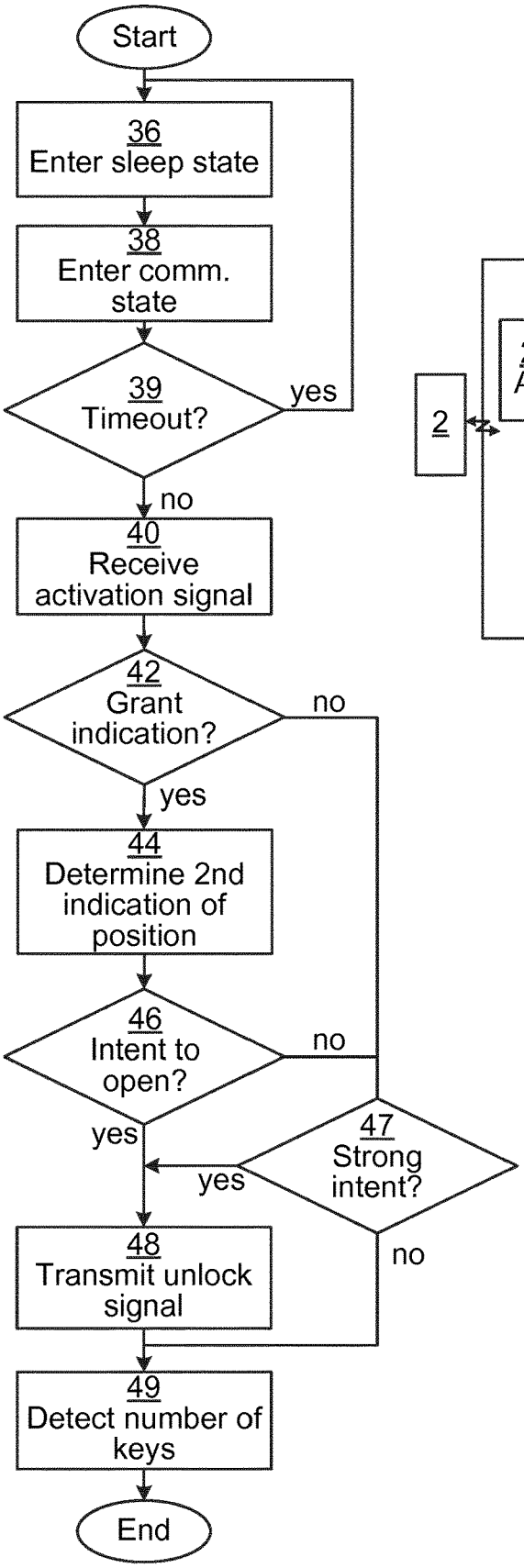
FIG. 3 is a flow chart illustrating an embodiment of a method performed in any one of the lock controllers of FIG. 1 for controlling a lock configured to control access to a restricted physical space.

FIG. 3 is a flow chart illustrating an embodiment of a method performed in any one of the lock controllers 18*a-d* of FIG. 1 for controlling a lock configured to control access to a restricted physical space. The method is here described in the context of one of the lock controller.

In an enter sleep state step 36, the lock controller enters a sleep state (70), in which the lock controller is unable to receive an activation signal. The sleep state can be maintained until a timer notifies the lock controller to enter a communication state.

In an enter communication state step 38, the lock controller enters a communication state (71), in which the lock controller is able to receive an activation signal In a conditional timeout step 39, the lock controller determines whether an inactivity timeout has been triggered, i.e. that the lock controller has been inactive for more than T seconds, where T is any non-negative real number. The lock controller is considered to be active when any of the steps mentioned below are performed.

In a receive activation signal step 40, an activation signal is received from an activation device, while in the communication state. The activation signal is based on the portable key device being located within the active space associated with the lock. This is determined by the activation device based on a first indication of position of the portable key device obtained from a first positioning procedure. The first positioning procedure use any suitable procedure. For instance, the position of the portable key device can be determined based on a satellite based positioning system such as GPS (Global Positioning System) or angle of arrival measurements. Angle of arrival measurements can be done when there are at least two antennas. When a wireless signal is received from the portable key device 2, a time difference in receiving the wireless signal can be detected. This can e.g. be detected using a phase difference between the received signals. Using the time difference, an angle of arrival (AoA) is calculated. The AoA is an angle in relation to a line between the antennas. The measurement can be performed for two pairs of antennas (optionally one antenna is mutual in the two pairs), to obtain two lines of direction to the portable key device 2. The position of the portable key device can then be determined as the position where the two lines cross. More pairs of antennas can be used to gain better precision and/or position determination in three dimensions. Alternative or additional procedures for determining position of the portable key device can be applied in the first positioning procedure.

In one embodiment, each one of the active spaces is defined in three dimensions and the position of the portable key device is also determined in three dimensions, corresponding to the embodiment shown in FIG. 2 and described above.

The activation signal comprises an identifier of the portable key device.

The activation device optionally takes into account history of movement and/or access decisions for the portable key device, when determining whether to send an activation signal or not.

In a conditional grant indication step 42, it is determined whether a grant indication is obtained. The grant indication is an indication that the portable key device is granted access to the lock. Optionally, the indication that the portable key device is granted access forms part of the activation signal, in which case it is the activation device (or other device in communication with the activation device) which performs the determination whether the portable key device is to be granted access or not. In this case, the position of the portable key device (as determined using the first positioning procedure) can be used to determine which lock to evaluate access for.

Alternatively, the lock controller determines access based on communication between the lock controller and the portable key device to authenticate the portable key device. In other words, the lock controller authenticates the portable key device. This communication with the portable key device can e.g. be over Ultra High Frequency, UHF, Ultra Wide Band, UWB. Such communication can also be used for position determination of the portable key device for the second positioning procedure, e.g. using angle of arrival as explained above. Optionally, access is checked in communication with a central server of a central access control system to provide online access control.

If the grant indication is obtained, the method proceeds to a determine second indication of position step 44. Otherwise, the method ends.

In the determine second indication of position step 44, a second indication of position of the portable key device is determined using a second positioning procedure. The second positioning procedure is more accurate than the first positioning procedure. Also the second positioning procedure can have a much shorter range of positioning than the first positioning procedure, since this is only activated once the portable key device 2 is within the active area of the lock controller.

The second positioning procedure can be more power restricted than the first positioning procedure. For instance, the power source for the second positioning procedure can be more power limited than the first positioning procedure, e.g. a battery is used for the second positioning procedure in the lock controller but mains power is used for the first positioning procedure in the activation device. The second positioning procedure can be such that the position of the portable key device can more accurately be determined to be inside or outside the barrier. This can be of great importance, e.g. if a person walks by a lock on the inside, at which point the lock should not be unlocked, i.e. there is an absence of intent.

In a conditional intent to open step 46, the presence or not of intent to open is determined based on the second indication of position. In here, intent is associated with the second indication of position. The intent can be determined using a threshold of intent. In this way, seamless unlocking can be implemented, where the user can walk up to a lock with the portable key device in a pocket or handbag, etc. Such a threshold can be based on timer and/or distance from the lock controller. Examples of thresholds are "closer than 50 cm", "being within range for longer than 5 seconds". Combination thresholds are also possible such as "being closer than 50 meter for longer than 5 seconds".

Optionally, the threshold of determining intent is based on the identity of the portable key devices. For instance, the lock controller can determine that the identity of the portable key device has a connection with the particular lock, e.g. the lock controls access to the user's office or hotel room. In such a case, intent can be easier to determine to reduce the time that the user may have to wait in front of the door until it is unlocked.

Optionally, the threshold of determining intent is based on historic data associated with the portable key devices. For instance, the portable key device may have unlocked the lock of this particular lock controller extensively before, in which case the intent threshold is lower, i.e. the intent is determined easier. In another instance, the portable key device may never have unlocked the lock of this particular lock controller before. The threshold can then be determined higher, i.e. it is more difficult to determine intent. This prevents inadvertent unlocking of locks, e.g. when walking past a lock controller while allowing easy access to spaces controlled by locks which are used frequently by the user.

Optionally, the threshold of determining intent of is based on time. For instance, if a user unlocks a lock using the lock controller but does not open the barrier, this can indicate an inadvertent unlocking. The intent threshold can then be raised temporarily so that repeated inadvertent unlocking is prevented.

Optionally, the threshold of determining intent is based on statistics of previously determined intent and corresponding opening of a barrier associated with the lock.

If it is determined that there is intent to open, the method proceeds to a transmit unlock signal step 48. Otherwise, the method ends, or proceeds to an optional conditional strong intent step 47, when present.

In the optional conditional strong intent step 47, it is determined whether there is strong intent to open. One example of strong intent is when the portable key device is in physical contact with the lock controller. Another example of strong intent is that a user interface device (e.g. button) of the lock controller is activated. Another example of strong intent is, when the activation device is implemented in the portable key device (e.g. as part of a smartphone), that the user presses an activation user element in the smartphone, which results in a strong intent signal being transmitted to the lock controller. If it is determined that there is strong intent to open, the method proceeds to the transmit unlock signal step 48. Otherwise, the method ends. In this way, the strong intent can be used as a fallback to activate the lock controller if the intent (evaluated in step 46) is not sufficient to detect the intent of the user.

In the transmit unlock signal step 48, an unlock signal is transmitted to the lock associated with the lock controller.

In an optional detect number of keys step 48, it is detected, using the second positioning procedure, how many portable key devices pass through a physical barrier associated with the active space. This can e.g. be used to track the number of people in the restricted physical space, e.g. if there is a fire.

By using the first positioning procedure to identify a general position of the portable key device, the second positioning procedure does not need to be activated until the portable key device is within the active area. This makes it possible that the lock controllers do not need to constantly detect the presence or absence of portable key devices; it is sufficient that the lock controllers can be activated by a specific activation signal from the activation device, while in the communication state. Between times of being in the communication state, the lock controllers can be in a extremely power efficient sleep state. In other words, the communication state can be entered on a schedule to allow message receiving. In this way, power requirements for the lock controllers is greatly reduced, which makes it more feasible to power the lock controllers using batteries and still be unlockable using simply the presence of the portable key device, i.e. using seamless unlocking. In this way, the lock controllers do not need to be powered by mains power and last much longer on battery power.

Figure 4:
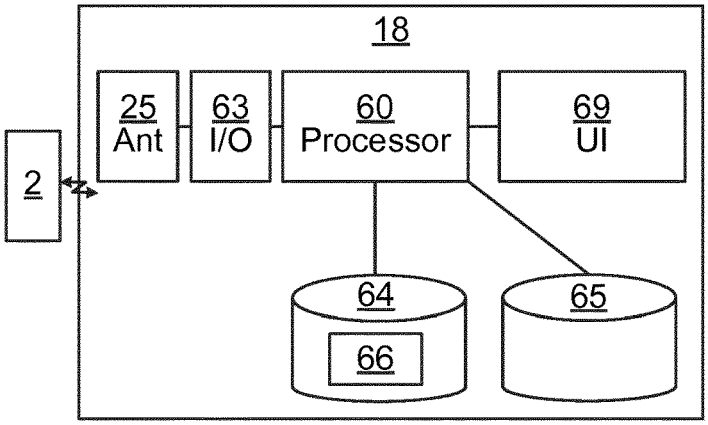
FIG. 4 is a schematic diagram illustrating an embodiment of any one of the lock controllers of FIGS. 1-2.

FIG. 4 is a schematic diagram illustrating an embodiment of any of the lock controllers 18*a-d* of FIG. 1, here represented by a single lock controller 18.

A processor 60 controls the general operation of lock controller 18. The processor 60 can be any combination of one or more of a suitable central processing unit (CPU), multiprocessor, microcontroller unit (MCU), digital signal processor (DSP), application specific integrated circuit (ASIC) etc., capable of executing software instructions or otherwise configured to behave according to predetermined logic. Hence, the processor 60 can be capable of executing software instructions 66 stored in a memory 64, which can thus be a computer program product. The processor 60 can be configured to execute the method described with reference to FIG. 3 above.

The memory 64 can be any combination of random access memory (RAM) and read only memory (ROM). The memory 64 also comprises persistent storage, which, for example, can be any single one or combination of magnetic memory, optical memory, solid state memory or even remotely mounted memory.

A data memory 65 is also provided for reading and/or storing data during execution of software instructions in the processor 60, for instance positions of one or more portable key devices. The data memory 65 can be any combination of random access memory (RAM) and read only memory (ROM).

The lock controller 18 further comprises an I/O interface 63 for communicating with other external entities such as a lock 12, the activation device and a portable key device 2, e.g. to exchange digital authentication data. The I/O interface 63 communicates with the portable key device 2 over a wireless interface using one or more antennas 25. The I/O interface 63 comprises necessary circuitry (e.g. transceivers, etc.) for supporting wireless communication over any suitable wireless interface, e.g. using Bluetooth, Bluetooth Low Energy (BLE), any of the IEEE 802.15 standards, Radio Frequency Identification (RFID), Near Field Communication (NFC), UHF UWB, any of the IEEE 802. 11 standards, wireless USB, etc. For each wireless interface, the I/O interface 63 is connected to the antenna(s) 25, as suitable. For communication with the lock 12, e.g. for sending an unlock signal, the I/O interface 63 may also support any of the wireless interfaces or wire based communication, e.g. using Universal Serial Bus (USB), Ethernet, serial connection (e.g. RS-485). The I/O interface 63 may also support communication with a central server for online access control using any of the wireless or wired communication interfaces.

Optionally, the lock controller 18 also includes a user interface 69, e.g. comprising any one or more of a light emitting diodes (LED) or other lights, a display, keys or keypad, etc.

Similarly, the activation device 13 can comprise a corresponding processor 60, memory 64, I/O interface 63 and data memory 65.

Figure 5:
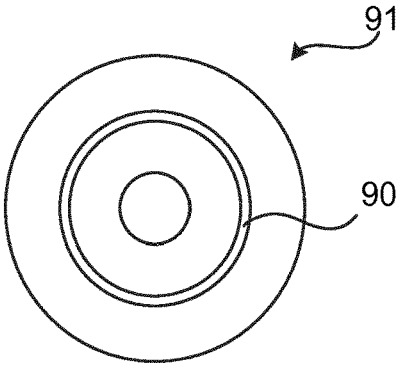
FIG. 5 shows one example of a computer program product comprising computer readable means.

FIG. 5 shows one example of a computer program product comprising computer readable means. On this computer readable means a computer program 91 can be stored, which computer program can cause a processor to execute a method according to embodiments described herein. In this example, the computer program product is an optical disc, such as a CD (compact disc) or a DVD (digital versatile disc) or a Blu-Ray disc. As explained above, the computer program product could also be embodied in a memory of a device, such as the computer program product 64 of FIG. 4. While the computer program 91 is here schematically shown as a track on the depicted optical disk, the computer program can be stored in any way which is suitable for the computer program product, such as a removable solid state memory, e.g. a Universal Serial Bus (USB) drive.

Figure 6:
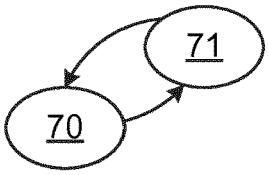
FIG. 6 is a state diagram illustratin T the states of any one of the lock controller the lock controllers of FIG. 1.

FIG. 6 is a state diagram illustrating the states of any one of the lock controller the lock controllers 18*a-d* of FIG. 1.

In a sleep state 70, the lock controller is in a power saving sleep state. In this state, the lock controller is unable to receive or transmit signals.

In a communication state 71 the lock controller is able to receive and/or transmit signals. This could also be considered to be an active state, where the lock controller is active and can perform various functions.

The transition from the sleep state 70 to the communication state 71 can be based on time. For instance, the lock controller can be configured to enter the communication state according to a schedule, to be able to receive signals, such as an activation signal, in a preconfigured time slot. Alternatively or additionally, the lock controller can advertise its presence in such a time slot, after which a device can send signals to the lock controller. The time slots need to be sufficiently sparse to gain the desired power efficiency, while sufficiently frequent to provide desired responsiveness. In one embodiment, the time slots are scheduled once every T seconds, where T is a value between 0.5 and 2.

The transition from the communication state to the sleep state 70 can be based on a timeout, such that after a certain time of inactivity, the lock controller again enters the sleep state.

Here now follows a list of embodiments from another perspective, enumerated with roman numerals.

i. A method for controlling a lock configured to control access to a restricted physical space, the method being performed in a lock controller connected to the lock, the lock being one of a plurality of locks, wherein there is a respective active space associated with each one of the plurality of locks, the method being performed by the lock controller and comprising the steps of:

receiving an activation signal from an activation device, the activation signal being based on the portable key device being located within the active space associated with the lock, based on a first indication of position of the portable key device obtained from a first positioning procedure;

obtaining an indication that the portable key device is granted access to the lock;

determining a second indication of position of the portable key device using a second positioning procedure, wherein the second positioning procedure is more accurate than the first positioning procedure;

determining general intent to open based on the second indication of position; and transmitting an unlock signal to the lock associated with the lock controller.

ii. The method according to claim i, wherein the indication that the portable key device is granted access forms part of the activation signal.

iii. The method according to claim i, wherein the step of obtaining the indication that the portable key device is granted access to the lock comprises determining access based on communication between the lock controller and the portable key device to authenticate the portable key device.

iv. The method according to any one of the preceding claims, wherein in the step of determining general intent to open, a threshold of determining general intent is based on the identity of the portable key devices.

v. The method according to claim iv, wherein in the step of determining general intent to open, a threshold of determining general intent is based on historic data associated with the portable key devices.

vi. The method according to any one of the preceding claims, wherein in the step of determining general intent to open, a threshold of determining general intent of is based on time.

vii. The method according to any one of the preceding claims, wherein in the step of determining general intent to open, a threshold of determining general intent is based on statistics of previously determined general intent and corresponding opening of a barrier associated with the lock.

viii. The method according to any one of the preceding claims, further comprising the step of:

detecting, using the second positioning procedure, how many portable key devices pass through a physical barrier associated with the lock.

ix. The method according to any one of the preceding claims, further comprising the step of:

determining whether there is strong intent to open, wherein the step of transmitting an unlock signal is performed when there is strong intent.

x. A lock controller for controlling a lock configured to control access to a restricted physical space, the lock being one of a plurality of locks, wherein there is a respective active space associated with each one of the plurality of locks, the lock controller comprising:

a processor; and a memory storing instructions that, when executed by the processor, cause the lock controller to:

receive an activation signal from an activation device, the activation signal being based on the portable key device being located within the active space associated with the lock, based on a first indication of position of the portable key device obtained from a first positioning procedure;

obtain an indication that the portable key device is granted access to the lock;

determine a second indication of position of the portable key device using a second positioning procedure, wherein the second positioning procedure is more accurate than the first positioning procedure;

determine intent to open based on the second indication of position; and transmit an unlock signal to the lock associated with the lock controller.

xi. The lock controller according to claim x, wherein the instructions to determine intent to open comprise instructions that, when executed by the processor, cause the lock controller to use a threshold of determining intent based on the identity of the portable key devices.

xii. The lock controller according to claim x or xi, wherein instructions to determine intent to open comprise instructions that, when executed by the processor, cause the lock controller to use a threshold of determining intent based on historic data associated with the portable key devices.

xiii. A computer program for controlling a lock configured to control access to a restricted physical space, the method being performed in a lock controller connected to the lock, the lock being one of a plurality of locks, wherein there is a respective active space associated with each one of the plurality of locks, the computer program comprising computer program code which, when run on a lock controller, causes the lock controller to:

receive an activation signal from an activation device, the activation signal being based on the portable key device being located within the active space associated with the lock, based on a first indication of position of the portable key device obtained from a first positioning procedure;

obtain an indication that the portable key device is granted access to the lock;

determine a second indication of position of the portable key device using a second positioning procedure, wherein the second positioning procedure is more accurate than the first positioning procedure;

determine intent to open based on the second indication of position; and transmit an unlock signal to the lock associated with the lock controller.

xiv. A computer program product comprising a computer program according to claim xiii and a computer readable means on which the computer program is stored.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A method for controlling a lock configured to control access to a restricted physical space, the method being performed in a lock controller connected to the lock, the lock being one of a plurality of locks, wherein there is a respective active space associated with each one of the plurality of locks, the method being performed by the lock controller and comprising:

entering a sleep state, in which the lock controller is unable to receive an activation signal;

entering a communication state, in which the lock controller is able to receive an activation signal;

receiving, while in the communication state, an activation signal from an activation device, the activation signal being based on a portable key device being located within the active space associated with the lock, based on a first indication of position of the portable key device obtained from a first positioning procedure;

obtaining an indication that the portable key device is granted access to the lock;

determining a second indication of position of the portable key device using a second positioning procedure, wherein the second positioning procedure is more accurate than the first positioning procedure;

determining a threshold of intent based on the identity of the portable key device, wherein the threshold of intent is expressed as a distance of the portable key device from the lock controller and/or a duration of the portable key device being within communication range;

determining intent to open based on the second indication of position and the threshold of intent; and transmitting an unlock signal to the lock associated with the lock controller.

2. The method according to claim 1, wherein the indication that the portable key device is granted access forms part of the activation signal.

3. The method according to claim 1, wherein obtaining the indication that the portable key device is granted access to the lock comprises determining access based on communication between the lock controller and the portable key device to authenticate the portable key device.

4. The method according to claim 1, wherein in determining intent to open, the threshold of determining intent is also based on historic data associated with the portable key device.

5. The method according to claim 1, wherein in determining intent to open, the threshold of determining intent of is also based on time.

6. The method according to claim 1, wherein in determining intent to open, the threshold of determining intent is also based on statistics of previously determined intent and corresponding opening of a barrier associated with the lock.

7. The method according to claim 1, further comprising:

detecting, using the second positioning procedure, how many portable key devices pass through a physical barrier associated with the lock.

8. The method according to claim 1, further comprising:

determining whether there is strong intent to open, wherein the step of transmitting an unlock signal is performed when there is strong intent.

9. A lock controller for controlling a lock configured to control access to a restricted physical space, the lock being one of a plurality of locks, wherein there is a respective active space associated with each one of the plurality of locks, the lock controller comprising:

a processor; and a memory storing instructions that, when executed by the processor, cause the lock controller to:

enter a sleep state, in which the lock controller is unable to receive an activation signal;

enter a communication state, in which the lock controller is able to receive an activation signal;

receive, while in the communication state, an activation signal from an activation device, the activation signal being based on a portable key device being located within the active space associated with the lock, based on a first indication of position of the portable key device obtained from a first positioning procedure;

obtain an indication that the portable key device is granted access to the lock;

determine a second indication of position of the portable key device using a second positioning procedure, wherein the second positioning procedure is more accurate than the first positioning procedure;

determine a threshold of intent based on the identity of the portable key device, wherein the threshold of intent is expressed as a distance of the portable key device from the lock controller and/or a duration of the portable key device being within communication range;

determine intent to open based on the second indication of position; and transmit an unlock signal to the lock associated with the lock controller.

10. The lock controller according to claim 9, wherein instructions to determine intent to open comprise instructions that, when executed by the processor, cause the lock controller to use the threshold of determining intent that is also based on historic data associated with the portable key device.

11. A computer program stored on a non-transitory computer readable medium for controlling a lock configured to control access to a restricted physical space, the method being performed in a lock controller connected to the lock, the lock being one of a plurality of locks, wherein there is a respective active space associated with each one of the plurality of locks, the computer program comprising computer program code which, when run on a lock controller, causes the lock controller to:

enter a sleep state, in which the lock controller is unable to receive an activation signal;

enter a communication state, in which the lock controller is able to receive an activation signal;

receive, while in the communication state, an activation signal from an activation device, the activation signal being based on a portable key device being located within the active space associated with the lock, based on a first indication of position of the portable key device obtained from a first positioning procedure;

obtain an indication that the portable key device is granted access to the lock;

determine a second indication of position of the portable key device using a second positioning procedure, wherein the second positioning procedure is more accurate than the first positioning procedure;

determine a threshold of intent based on the identity of the portable key device, wherein the threshold of intent is expressed as a distance of the portable key device from the lock controller and/or a duration of the portable key device being within communication range;

determine intent to open based on the second indication of position and the threshold of intent and transmit an unlock signal to the lock associated with the lock controller.

12. A computer program product comprising a computer program stored on the non-transitory computer readable medium according to claim 11.

13. An access control system for controlling a lock configured to control access to a restricted physical space, the lock being one of a plurality of locks, wherein there is a respective active space associated with each one of the plurality of locks, the access control system comprising an activation device comprising:

a processor; and a memory storing instructions that, when executed by the processor, cause the activation device to:

determine a first indication of position of the portable key device using a first positioning procedure;

determine when the portable key device is located within the active space associated with the lock, based on the first indication of position;

transmit an activation signal to the lock controller associated with the lock of the active space, when the portable key device is located within the active space associated with the lock;

wherein the access control system further comprising a plurality of lock controllers, each one of which comprises:

a processor; and a memory storing instructions that, when executed by the processor, cause the lock controller to:

enter a sleep state, in which the lock controller is unable to receive an activation signal;

enter a communication state, in which the lock controller is able to receive an activation signal;

receive, while in the communication state, an activation signal from the activation device;

obtain an indication that the portable key device is granted access to the lock;

determine a second indication of position of the portable key device using a second positioning procedure, wherein the second positioning procedure is more accurate than the first positioning procedure;

determine a threshold of intent based on the identity of the portable key device, wherein the threshold of intent is expressed as a distance of the portable key device from the lock controller and/or a duration of the portable key device being within communication range;

determine intent to open based on the second indication of position; and transmit an unlock signal to the lock associated with the lock controller.

14. The method according to claim 1, wherein the threshold of intent comprises a component expressed as a distance of the portable key device from the lock controller, and wherein intent is determined only when the portable key device is closer than the distance.

15. The method according to claim 1, wherein the threshold of intent comprises a component expressed as a duration of being within communication range, and wherein intent is determined only when the portable key device is within communication range for a period being longer than the duration.

* * * * *